US007188474B2

(12) United States Patent
van de Loo

(10) Patent No.: US 7,188,474 B2
(45) Date of Patent: Mar. 13, 2007

(54) RECIPROCATING ENGINE AND INLET SYSTEM THEREFOR

(75) Inventor: Paul van de Loo, Norton Summit (AU)

(73) Assignee: Cogen Microsystems Pty Ltd., Thebarton (AU)

( * ) Notice: Subject to any disclaimer, the term of this patent is extended or adjusted under 35 U.S.C. 154(b) by 112 days.

(21) Appl. No.: 10/949,574

(22) Filed: Sep. 27, 2004

(65) Prior Publication Data

US 2005/0091980 A1 May 5, 2005

Related U.S. Application Data

(63) Continuation of application No. PCT/AU03/00396, filed on Mar. 28, 2003.

(30) Foreign Application Priority Data

Mar. 28, 2002 (AU) ..... PS1414
Dec. 24, 2002 (AU) ..... 2002953574

(51) Int. Cl.
*F01K 13/02* (2006.01)

(52) U.S. Cl. ..... 60/660; 91/461

(58) Field of Classification Search ..... 60/508, 60/643, 660; 91/304, 308, 461
See application file for complete search history.

(56) References Cited

U.S. PATENT DOCUMENTS 3,237,847 A * 3/1966 Wilson ..... 60/508
3,853,100 A * 12/1974 Braun ..... 123/46 R
4,042,311 A 8/1977 Yonezawa
5,050,482 A * 9/1991 Yonezawa et al. ..... 91/304
5,224,683 A 7/1993 Richeson
5,346,360 A * 9/1994 Cooper ..... 415/38
5,493,945 A * 2/1996 Matsumura ..... 91/304
5,806,403 A 9/1998 Johnston
5,832,944 A * 11/1998 Lindner ..... 137/1
6,092,495 A 7/2000 Hackett
6,263,843 B1 7/2001 Todo et al.
6,272,855 B1 8/2001 Leonardi
6,508,060 B2 * 1/2003 Clemens et al. ..... 60/643

FOREIGN PATENT DOCUMENTS

DE 102 34 503 4/2004

OTHER PUBLICATIONS

Tood Neff, Sturman's Valve Opens Door to Potential Riches, Front Range Techbiz (Sep. 24-30, 2001) No. 9 (2 pgs).
Tsu-Chin Tsao et al., Electrohydraulic Valvetrains for Direct Injection Compression Ignition Camless Engine Operations—Phase I Project Final Report (May 2000) Dept of Energy: Carat Program Doe DEFC02-98EE50540 (pp. i-33).
John Steven Brader, Development of a Piezoelectric Controlled Hydraulic Actuator for a Camless Engine, Master Thesis- Univ South Carolina (2001) pp. i-84.

* cited by examiner

*Primary Examiner*—Hoang Nguyen
(74) *Attorney, Agent, or Firm*—Buchanan Ingersoll & Rooney PC

(57) ABSTRACT

The invention relates to a reciprocating engine and a working fluid inlet system therefore. The engine includes at least one cylinder with a reciprocating piston therein and a variable volume expansion chamber capable of receiving a working fluid via an inlet valve. The inlet system includes a pilot valve having an open condition and a closed condition. In the open condition, the secondary fluid passes therethrough to act on the inlet valve. The system also includes an actuating means for controlling the condition of the pilot valve. The inlet valve is adapted to open in response to the action of the secondary fluid. The engine may also include exhaust means, possibly by porting in the piston and a cylinder wall. The working fluid may be used as the secondary fluid.

61 Claims, 13 Drawing Sheets

RECIPROCATING ENGINE AND INLET SYSTEM THEREFOR

FIELD OF THE INVENTION

The present invention relates to a reciprocating engine and to a working fluid inlet system for a reciprocating engine, such as a steam inlet system for a heat engine such as a Rankine cycle engine, the reciprocating engine being of the type that does not rely upon an internal chemical reaction (such as an internal combustion engine) for the reciprocating movement.

BACKGROUND OF THE INVENTION

One of the earliest forms of engine developed for providing mechanical work was a Rankine cycle engine, often referred to as a 'steam engine' because the majority of such engines used steam as their working fluid (and were thus considered to be steam driven). Steam engines were reciprocating engines that typically had a reciprocating piston in a cylinder, with an inlet valve and an exhaust valve (usually at the same end of the cylinder), the piston being connected by a rod and a crank to a flywheel or the like.

During operation of the engine, with the piston at 'top dead centre' (referred to as 'TDC'), the inlet valve was opened, allowing steam to enter from a boiler. The expanding steam drove the piston in its expansion (or power) stroke, whereupon the inlet valve would close, allowing the steam in the cylinder to expand to a lower pressure. As the piston reached 'bottom dead centre' (referred to as 'BDC'), the exhaust valve would open allowing the steam, which was generally still at significant pressure, to escape as the piston travelled back up the cylinder to TDC on its return stroke.

In such an operation, it is ideal to open and close the inlet valve infinitely quickly, and to close the inlet valve early in the power stroke, providing a high expansion ratio. However, in the early 1900's valve actuation technology was limited and poor efficiencies were thus accepted throughout the development of such engines. Indeed, the inability to close the inlet valve early enough was a major factor leading to the development of compound engines (double, triple and even quadruple expansion engines) where steam would be routed to a second, larger capacity cylinder where it was similarly expanded. Sometimes there was also a third, or even a fourth stage where this would be repeated.

While engines of this type generally performed satisfactorily, subsequent developments in engine design produced engines of greater efficiency and higher horsepower to weight ratios, such as the internal combustion engine, the steam turbine and the like. As a result, the use of steam engines fell away, so much so that steam engines became quite rare.

However, with increasing emphasis on environmental and pollution considerations, and with the continuing rise in the price of fossil fuels, there has recently been renewed interest in steam engines, particularly for use in small cogeneration or combined heat and power (CHP) systems.

Accordingly, there is a renewed need for improvements to, in particular, the inlet valve systems for such steam engines and, in general, to the working fluid inlet systems for reciprocating engines of any type where a high pressure gas or vapour is fed to a cylinder in a controlled manner.

SUMMARY OF THE INVENTION

The present invention provides a working fluid inlet system for a reciprocating engine, the engine including at least one cylinder with a reciprocating piston therein and having a variable volume expansion chamber capable of receiving a working fluid via an inlet valve, the inlet system including:

a pilot valve having an open condition where secondary fluid passes therethrough to act on the inlet valve, and a closed condition; and actuating means for controlling the condition of the pilot valve; wherein the inlet valve is adapted to open in response to the action of the secondary fluid.

The present invention also provides a reciprocating engine utilizing the working fluid inlet system described above, together with a method of operating such a reciprocating engine. In this respect, the engine may have one or more reciprocating piston/cylinder arrangements, there being at least one of the inlet systems of the present invention associated therewith.

Indeed, the present invention also provides a reciprocating engine including at least one cylinder with a reciprocating piston therein and having a variable volume expansion chamber capable of receiving a working fluid via an inlet valve, the engine including a working fluid inlet system and exhaust means, the working fluid inlet system including a pilot valve having an open condition where secondary fluid passes therethrough to act on the inlet valve, and a closed condition, and actuating means for controlling the condition of the pilot valve, wherein the inlet valve is adapted to open in response to the action of the secondary fluid, the exhaust means including at least one exhaust valve in the piston and at least one exhaust port in the piston, the exhaust valve being configured to open automatically when the pressure above the piston drops to a threshold pressure above an exhaust port pressure.

Ideally, as will be explained below, the reciprocating engine will be a Rankine cycle engine that uses steam as the working fluid, and that has only a single reciprocating piston/cylinder arrangement that preferably operates on the uniflow principle. However, it will be appreciated that the reciprocating engine need not necessarily contain a 'piston' and a 'cylinder' in the traditional sense, but rather simply needs to have an expansion volume and a positive displacement expander.

For example, a system of this type that may contain other than a piston/cylinder arrangement is a Wankel rotary expansion chamber comprising a triangular rotor which rotates on an eccentric shaft and is within, and geared to, an epitrochoidal housing. Thus, the continued reference throughout this specification to a piston/cylinder arrangement should be interpreted to cover at least this type of arrangement.

Also, in the preferred configuration the working fluid and the secondary fluid will be sourced from the same supply. Indeed, it is envisaged that, in most situations, the working fluid will be steam from a boiler, and the secondary fluid will also be steam, supplied by the same boiler (although the engine may be powered by solar energy or some other low grade heat source, and may use any organic working fluid). Thus, the reference to 'secondary fluid' throughout the specification should not be seen as requiring the secondary fluid to be of a different type (or from a different source) to the working fluid.

It will be appreciated that the inlet system of the present invention provides for rapid opening and closing of the inlet valve, and for the timing of at least the closing of the inlet valve to be controllable so as to be early in the expansion (power) stroke of the engine. Such ease of variable valve timing avoids the need to maintain constant inlet valve admission and cut-off timing, which in many traditional steam engines required throttling of the steam to run at part power, introducing obvious inefficiencies.

Additionally, the present invention permits the inlet valve to be actuated indirectly (by the pilot valve) rather than directly, which avoids the need for an electrical or mechanical actuating means capable of generating large forces at high speeds.

GENERAL DESCRIPTION OF THE INVENTION

The secondary fluid for use with the pilot valve may be any suitable fluid, pressurized in any suitable manner, and may for instance be any suitable pressurized liquid or gas/vapour. It is expected that the secondary fluid will usually be steam, although it should be understood that a suitable hydraulic fluid would suffice. Indeed, suitable fluids are envisaged to be water, air, nitrogen, synthetic and mineral oils, or suitable mixtures such as a water/glycol mixture.

Given that the preferred working fluid for the operation of the engine is steam (as will be explained below), whatever steam generation system is employed for that purpose may also be used to generate useful steam (as the secondary fluid) for the pilot valve. For example, in a preferred form, the steam for both the working fluid and the secondary fluid may be generated in a boiler, as mentioned above.

Boilers can be of many different architectures, but generally consist of a volume in which water is contained, such as a series of tubes. Heat is then applied to the exterior of this volume and is transferred through the walls of the vessel, causing the water to become heated and boil, producing steam. This is then commonly further heated to produce superheated steam. Common types of boilers include fire-tube boilers, water tube boilers, and flash boilers. In all types, water is typically added continuously or periodically to replenish that boiled off.

The pilot valve preferably operates between two conditions, namely its open condition and its closed condition. When in its open condition, the pilot valve permits passage of the secondary fluid therethrough to act on the inlet valve. In a preferred form, the pilot valve is urged towards its open condition against a closing force, such that the rest position for the pilot valve is its closed condition. An advantage of this arrangement is that the pilot valve can be configured so as to act as an emergency relief valve in the event of boiler overpressure, given that such overpressure will tend to open the valve rather than close it.

The pilot valve may be of any suitable type and may, for instance, be a poppet valve, a spool valve or a flapper valve. Where the pilot valve is a poppet valve, the poppet valve preferably opens by unseating a poppet from its seat, allowing fluid to pass.

Where the pilot valve is a spool valve, the spool valve preferably includes a stepped cylindrical spool in a sleeve that has radial flow ports. In this form, sliding the spool in the sleeve exposes the flow ports to open them. Advantageously, such a valve can be of the overlapped type. This provides a dead zone in the travel of the spool where the inlet valve is not in fluid communication with either the boiler or the exhaust port, thus preventing short-circuiting between the boiler and the exhaust port.

Where the pilot valve is a flapper valve, the flapper valve preferably includes a flapper that swings between two opposing nozzles by a continuous stream of secondary fluid via pressure drop orifices. Each nozzle preferably communicates with respective chambers in the inlet valve, where, in one form, a spool is held central by springs.

Turning now to the inlet valve of the system of the present invention, the inlet valve is preferably of a type that is also operable between open and closed conditions, in the preferred form in response to the action of the secondary fluid from the pilot valve. In its open condition, the inlet valve permits entry of the working fluid to the expansion chamber of the cylinder to do work on the piston as it expands, in the normal manner. Again, the inlet valve is preferably urged towards its open condition (preferably by the secondary fluid) against a closing force, such that the rest position for the inlet valve is also its closed condition.

The inlet valve may also be of any suitable type and will ideally either be a poppet valve or a spool valve. In one form, the inlet valve is a poppet valve and includes a poppet piston running in a cylinder to a poppet stem. The secondary fluid admitted by the pilot valve preferably exerts force on the poppet piston, overcoming a resilient means (such as a spring) which normally holds the poppet shut. This results in the inlet valve opening. Preferably, the area of the poppet piston on which the secondary fluid acts is larger than the poppet area, assuming that the pressures of the secondary fluid and the working fluid are the same.

In this form, the poppet valve may be oriented in either direction relative to the flow of pressurised fluid as it opens. Preferably, the poppet valve is oriented such that the boiler pressure tends to hold it closed. This avoids the need for a strong resilient force to hold it closed, as would be the case if the orientation were reversed. Further, this arrangement assists in avoiding leaks, as the increased pressure results in an increased closing force and thus increased sealing pressure (namely, valve seat contact pressure).

Referring to the actuating means of the system of the present invention, the actuating means preferably controls the operation of the pilot valve between its open condition and its closed condition. Whilst the preferred form of actuating means provides electrical actuation that is electronically controlled, it will be appreciated that the actuating means may be provided by a suitable mechanical, electrical, electromagnetic, piezoelectric or other actuation arrangement. A suitable such arrangement may be one that would give rise to similar precision and speed of operation of the pilot valve as is provided by the electronic means about to be described.

In a preferred form, the actuating means is an electronically controlled solenoid, the electronic control being provided by a control module in association with a timing means. In this form, the control module may include a processing device (such as a microcontroller) which is able to process set and dynamic parameters so as to provide a control signal (via an output port) to the solenoid, the control signal being suitable for actuating or holding the solenoid so as to control the pilot valve between its open and closed conditions.

In a preferred form of the invention, at least some of the dynamic parameters are provided by, or determined using, a signal from the timing means to the control module. The set parameters, on the other hand, may reside on the control module (for example, in FLASH memory, or an EPROM, or memory on-board a microcontroller) such that they are able to be accessed by the processing device. In this form of the invention, the set parameters are effectively pre-programmed into the control module.

The processing of the dynamic parameters preferably provides data such as crank-angle position and speed data, during operation of the engine.

Other dynamic parameters provided to the processing means may be any of the engine's operating conditions, such as the pressure of the working fluid and/or the secondary fluid, or the temperatures and pressures within the cylinder, although these will typically not be provided by the timing means.

The timing means may be any type of rotational position transducer that can provide 'real time' crank position data to the processing means. In a preferred form, the timing means will be a timing disc arranged to rotate with the crankshaft of the engine. The timing disc will preferably have pre-set protrusions thereon configured to be representative of predetermined crank-angle positions. Timing sensors may then be provided that are capable of sensing the passing of respective protrusions to generate timing signals for the processing means in order to determine crank-angle speed and position data.

By pre-programming the control module with set parameters related to, for instance, the delay time between energizing the solenoid and the opening of the pilot valve, the delay time between the pilot valve opening and the inlet valve opening, the delay time associated with gas flow, and variations to these delay times caused by changes in the engine's operating conditions, the processing means is able to determine, during operation, at what time shortly prior to the predicted next TDC time the solenoid should be energized. This permits the solenoid to actuate the pilot valve, which in turn opens the inlet valve, at precisely the required time with respect to the arrival of the piston at TDC.

Preferably, a very high initial voltage is provided to the solenoid, enabling the current, the associated magnetic field, and hence the solenoid plunger retraction force, to build up quickly, minimizing any delay time.

Further, once the solenoid plunger has commenced moving, the voltage and current are preferably lowered to a 'holding' value to maintain the plunger in a retracted position (and thus the pilot valve in its open condition) against the resilient means (such as a return spring). In this form, it is not essential to sense when the plunger commences moving—the time may be entered as one of the set parameters.

In the same manner, the control module may be pre-programmed with set parameters related to, for instance, the delay time between de-energising the solenoid and the closing of the pilot valve, the delay time between the pilot valve closing and the inlet valve closing, the delay time associated with gas flow and variations to these delay times caused by changes in the engine's operating conditions. Thus, the control module preferably sends the de-energisation signal to the solenoid shortly prior to the desired inlet valve closing time.

In this respect, and given that to achieve high expansion ratios the inlet valve should only remain open for a short time after TDC, any closing delay time is preferably short. In one form, this may be achieved by including means capable of rapidly dissipating the solenoid field energy to ensure rapid plunger extension under the influence of the resilient means (such as the return spring) when the solenoid de-energises.

Without such a rapid dissipation means, there is a risk that the solenoid de-energisation process would commence before the solenoid is fully energized for opening the pilot valve. This would, of course, lead to the inlet valve not opening fully, or at all, leading to a loss of efficiency.

Finally, the inlet system of the present invention may also be advantageously used to control the pressure that builds up in the dead space in the expansion chamber just before the piston reaches TDC. In one form, a pressure transducer may be included in the expansion chamber to monitor cylinder pressure. This could supply further dynamic parameters to the control module to vary the inlet opening timing slightly. For instance, in the event that the cylinder pressure gets too high in the final movement of the piston to TDC, the control module may energise the solenoid early to open the inlet valve earlier, allowing the pressure build up to vent to the boiler via the inlet valve.

In order to provide a general understanding of the manner of operation of a reciprocating engine having a working fluid inlet system in accordance with the present invention, an in-use scenario will briefly be described.

Once operating, the sequence of operating steps for a reciprocating engine of the steam driven Rankine cycle type will, in general terms, be as follows:

1. As the piston nears TDC, the actuating means operates to open the pilot valve against a closing force, permitting secondary fluid (steam) to move therethrough. The actuating means is preferably the electronically controlled solenoid/timing means arrangement described above, which is capable of predictively controlling the pilot valve between its open and closed conditions, in terms of being open and closed, and also in terms of the rate and timing of opening and closing.
2. The steam then engages with a suitable configured inlet valve, causing the inlet valve to open, again against a closing force.
3. The working fluid (steam) enters the expansion chamber of the cylinder via the inlet valve, expanding and forcing the piston away from TDC on its expansion (power) stroke, towards BDC.
4. The actuating means operates to close the pilot valve, denying steam to the inlet valve, and allowing the closing force to close the inlet valve.
5. Once the piston has passed BDC, it returns towards TDC on its return stroke. Expanded steam within the cylinder exhausts through exhaust valve(s) located in the cylinder wall and/or, more preferably, in the piston head itself. This latter configuration prevents the piston from having to work against the compression of steam in the cylinder during the return stroke, as will be described in more detail below.
6. As the piston again nears TDC, the actuating means again operates to open the pilot valve against the closing force, again permitting secondary fluid (steam) to move therethrough.
7. The cycle of steps 1 to 6 then continues.

In relation to the use of piston head exhaust valves, if utilized the exhaust valves are preferably configured so as to open automatically when the pressure above the piston drops to a threshold pressure above the exhaust port pressure. In this respect, the piston preferably includes exhaust ports associated with the exhaust valves, these piston exhaust ports venting to aligned exhaust ports in the cylinder wall (or the crankcase, if desired).

Preferably, the piston exhaust ports and the cylinder wall exhaust ports are configured to overlap during the entire stroke, allowing exhaust venting at any crank angle provided the exhaust valves are open. In a more preferred form, a conventional exhaust port opened by the piston just before BDC will also be used. This initiates exhausting in the event that cylinder pressure has not dropped sufficiently to allow the piston head exhaust valves to open.

The use of the such an exhaust valve arrangement with the inlet valve system of the present invention, which itself allows very early and sharp cut off, allows an engine to run very efficiently at virtually all load conditions. Indeed, the presence of both arrangements permits the engine to run at different displacements, effectively making it a variable displacement engine. Furthermore, the cylinder can of course be sized such that full expansion of the gas occurs at BDC when operating at full load, which would provide maximum efficiency. Then, at part loads the amount of inlet gas may be reduced such that full expansion occurs before the piston reaches BDC.

With this embodiment of the invention, the piston head exhaust valves would open so that gas could flow in the reverse direction through the valves (that is, into the expansion volume above the piston), thus avoiding doing work to generate a partial vacuum and again maintaining efficiency.

The piston head exhaust valves may be any suitable valves, although it is preferable that they be of a type that is not unduly influenced by the inertia forces generated as a result of the acceleration of the piston. Also, the exhaust valves should be of a type that ensures that the system of closing the valve at TDC does not lead to wear or damage of the valves.

The piston head exhaust valves will thus preferably be springs, and will ideally be reed valves. However, other arrangements could be used, such as poppet valves with compression coil spring arrangements.

Additionally, leaf springs may be used at the head of the cylinder to assist in closing the reed valves and also to cushion the impact of the piston head exhaust valves on the cylinder head. Whilst this impact is cushioned somewhat by the gas that must be expelled from between the faces of the reed valves and the leaf springs as they come into contact, other options to cushion this impact may be used, such as the use of fluid jets emanating from the cylinder head, or a fluid coating on the springs themselves may assist in prolonging the life of the reed valves.

From the above general description, it can be seen that the working fluid inlet system of the present invention provides a simple solution to the operation and control problems that have been associated with many types of reciprocating engines for many years.

In particular, the system of the invention is particularly useful as the inlet valve system for a Rankine cycle heat engine that uses steam as its working fluid to drive a piston. It permits an efficient reciprocating steam engine to be built without the cost, complexity, weight and size of multiple expansion cylinders, because a high expansion ratio can be achieved in one cylinder by providing early cut off.

A further advantage is that the valve timing may be fully programmable. Indeed, unlike many mechanisms, the timing of the admission and cut-off of working fluid to the expansion chamber can be varied independently and over a wide range, without the need for complex mechanisms.

BRIEF DESCRIPTION OF THE DRAWINGS

The present invention will now be described with reference to a preferred embodiment illustrated in the accompanying drawings. However, it is to be understood that the following description is not to limit the generality of the above description.

In the drawings.

DETAILED DESCRIPTION OF THE PREFERRED EMBODIMENT

Figure 1:
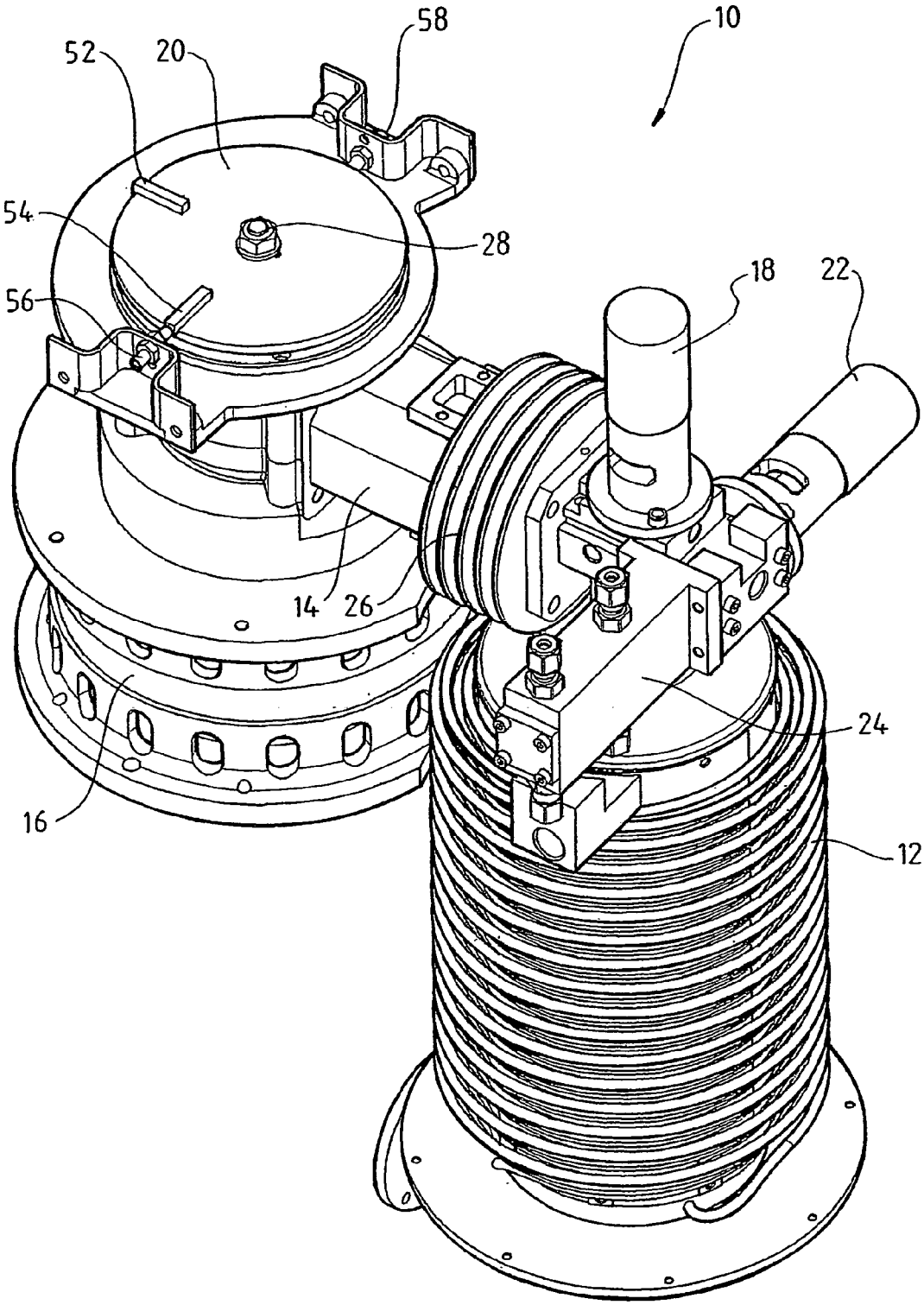
FIG. 1 is a perspective view of a reciprocating engine incorporating a working fluid inlet system in accordance with a preferred embodiment of the present invention.

Illustrated in FIG. 1 is a reciprocating engine 10 that operates on the Rankine cycle and uses steam as its working fluid. The engine 10 is not illustrated with all of the components necessary for operation, as will be explained shortly.

The engine 10 generally includes a boiler 12 suitable to generate the steam necessary for use as the working fluid and, for the preferred inlet system of the present invention, the secondary fluid. In this respect, a skilled addressee will appreciate that suitable flow passages for all aspects of the engine are not necessarily visible in all of the Figures. For example, a flow passage from the boiler 12 to the pilot valve in subsequent Figures is not evident in all cross-sections in the Figures, but of course is present in the engine.

The engine 10 includes a reciprocating piston in a cylinder, with a variable volume expansion chamber, shown generally by reference numeral 14. The reciprocating piston is operatively connected to an electrical generator 16 via a crankshaft 28 (not completely shown in FIG. 1).

FIG. 1 also shows parts of the engine that are unrelated to the present invention, such as the solenoid 22 and the injector pump 24 that regulate the flow of water into the boiler 12, together with several heat transfer vanes 26 that are associated with the TDC end of the cylinder.

In relation to the inlet system of the illustrated embodiment of the present invention, all that is evident from FIG. 1 is the presence of various aspects of the actuating means that controls the operation of the pilot valve. In particular, FIG. 1 shows the solenoid 18 and the timing disc 20, the timing disc 20 being operatively connected to the crankshaft 28. However, in FIG. 2 the timing disc 20 is better illustrated than in FIG. 1, in that its operative connection to the crankshaft 28 is apparent. Also, the cylinder 30 within which the piston 32 is configured for reciprocating movement (in the normal manner) is more apparent in FIG. 2 than in FIG. 1.

Figure 2:
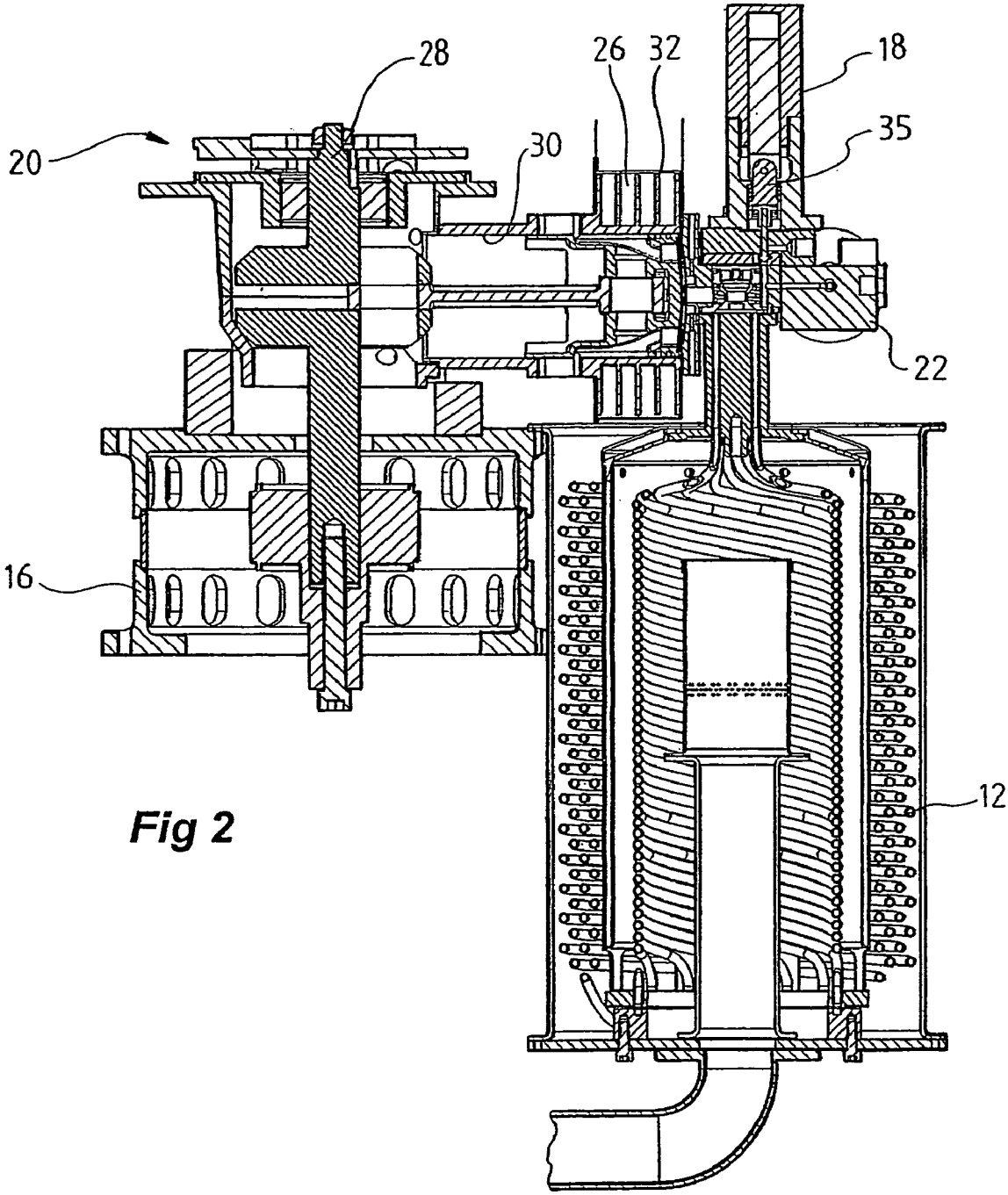
FIG. 2 shows a cross-section through the reciprocating engine of FIG. 1.

The elements such as the boiler 12, the generator 16, the vanes 26, and the water inlet solenoid/valve arrangement 22/24 are all also evident in FIG. 2, but will not be described in further detail. Indeed, with regard to the configuration and operation of the piston 32, the cylinder 30, the crankshaft 28, the generator 16, and their associated engine parts, these will be well understood by a skilled addressee and will not be described in further detail. These elements do not form an essential part of the inlet system of the present invention.

However, the interaction and configuration of the elements within the area marked A in FIG. 2 are important to the present invention and will now be described in further detail in conjunction with the illustrated elements of the actuating means of the present embodiement, namely the timing disc 20 and the solenoid 18.

Figure 3A:
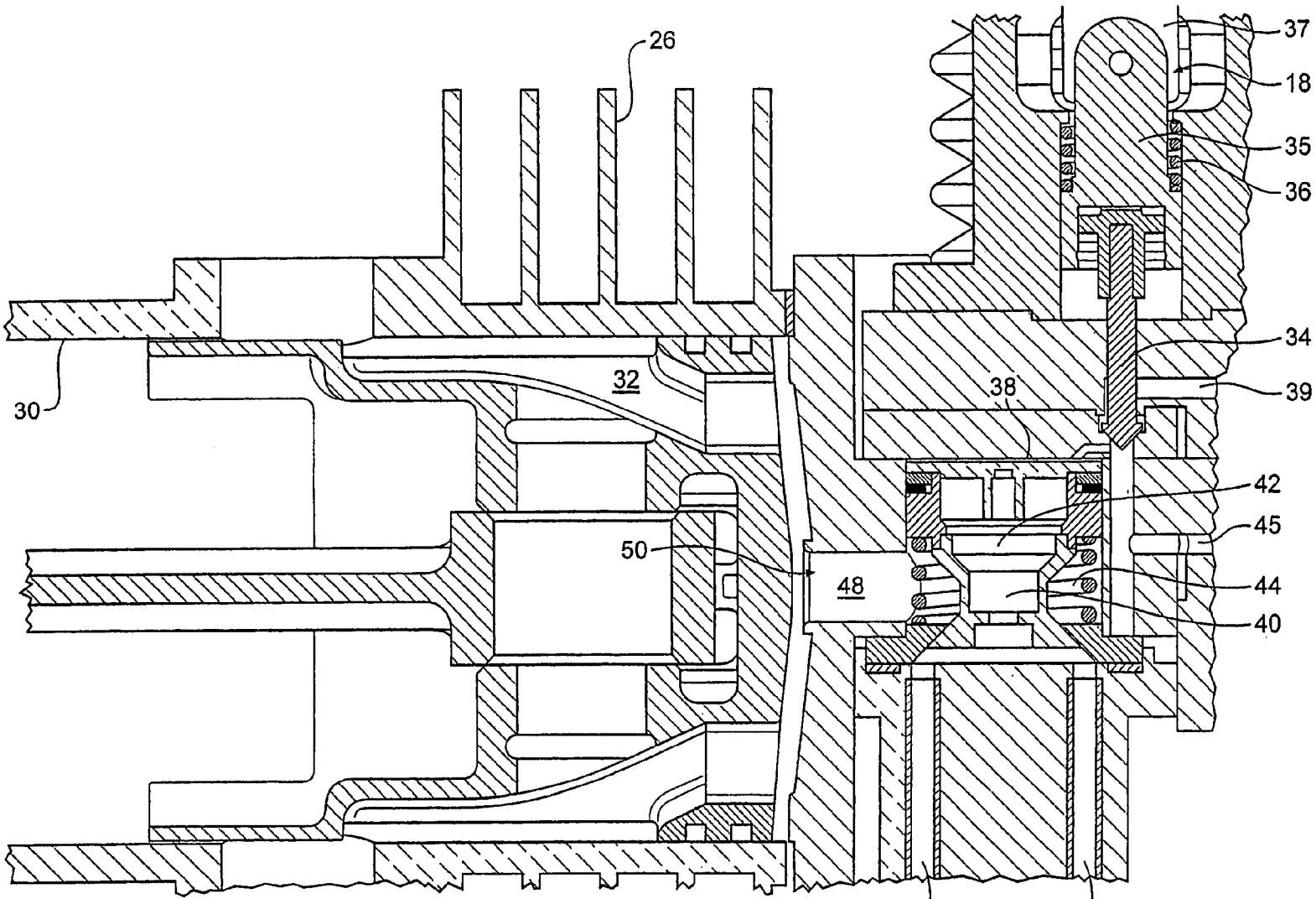
FIG. 3*a* is an exploded view of a part of the cross-section of FIG. 2, with the piston nearing TDC.
Figure 3B:
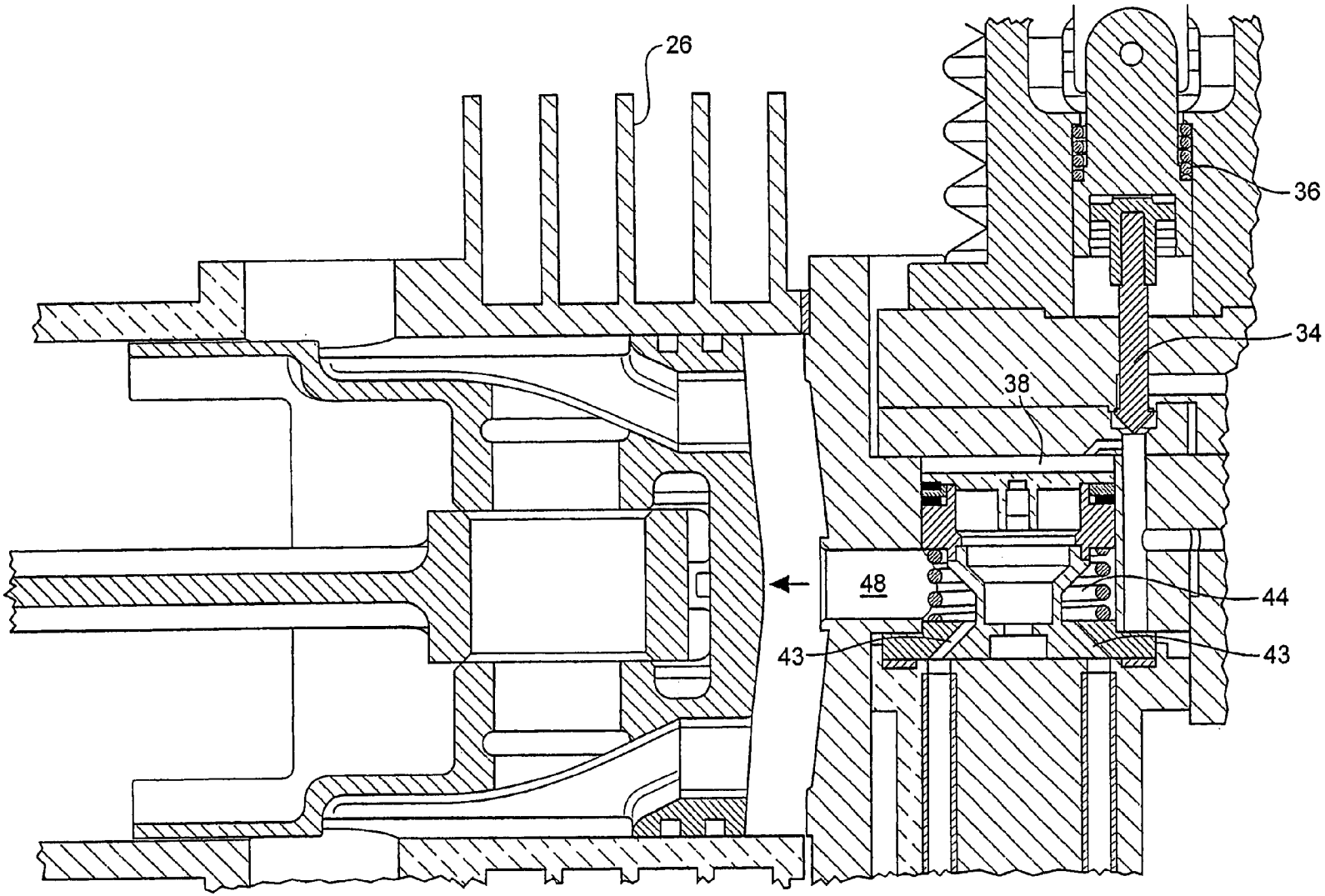
FIG. 3*b* is an exploded view of a part of the cross-section of FIG. 2 with the piston moving away from TDC and towards BDC.
Figure 3C:
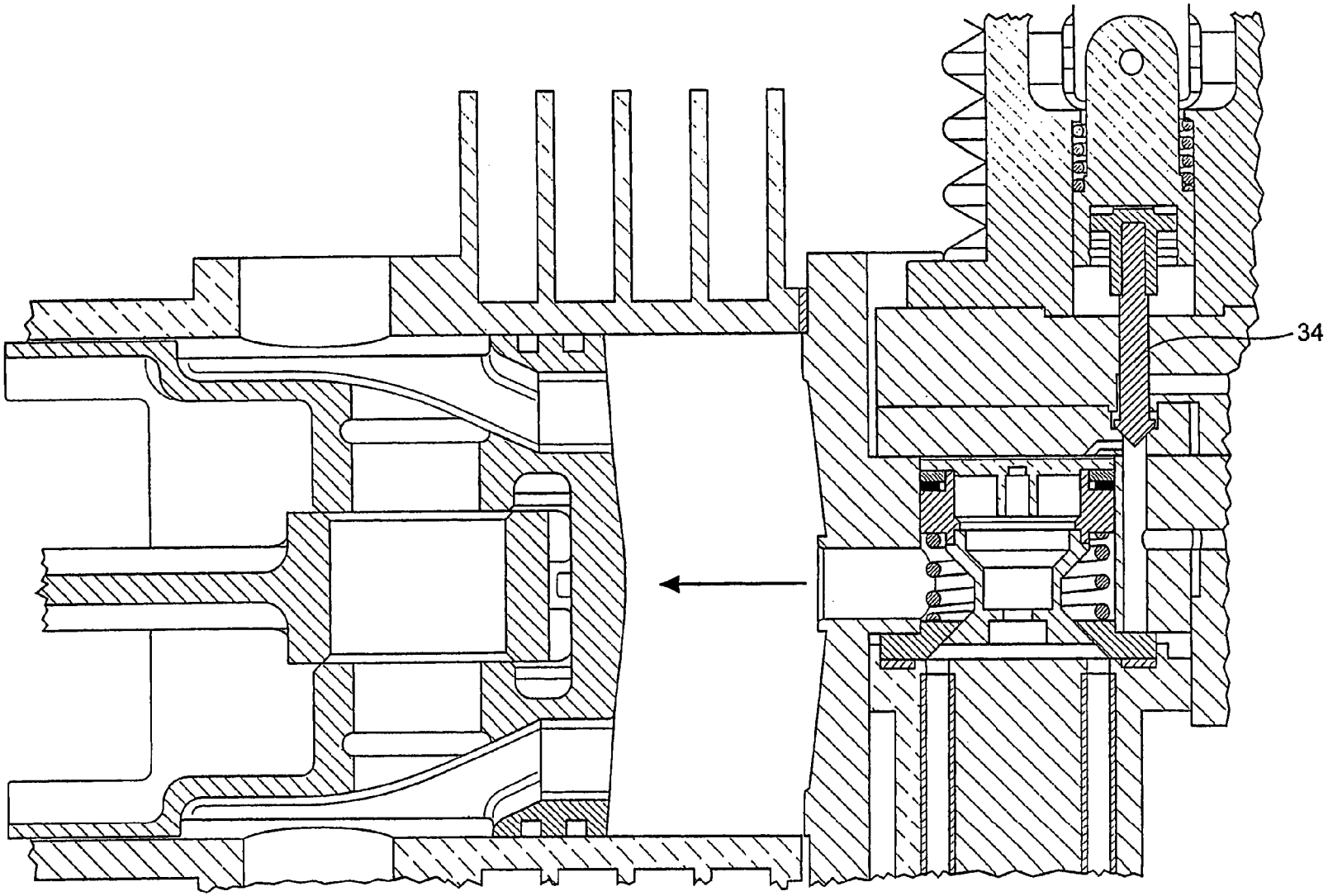
FIG. 3*c* is an exploded view of a part of the cross-section of FIG. 2 with the piston approaching BDC.

The inlet system of the present embodiment is best illustrated in FIGS. 3*a*, 3*b* and 3*c*. In this respect, although these figures provide a sequential illustration of the inlet system (and engine) in different conditions, most of the elements of the inlet system are common to each figure. It is thus suitable to describe those common elements before describing the sequential operation.

Referring simply to FIG. 3*a*, the solenoid 18 is operatively connected to a pilot valve that is shown in the form of a poppet valve 34. Since the solenoid 18 is not attached to the piston to be physically moved thereby, the solenoid can be considered as physically separate from the piston. The poppet valve 34 can be opened by the retraction of the solenoid's plunger 37 (in association with the link member 35) against a closing force provided by a spring 36. When in its open condition, the poppet valve allows passage of secondary fluid (steam) into the chamber 38 of the inlet valve 40, which in this embodiment is also a poppet valve. Additionally, steam is able to be fed to, for instance, an injector (not shown) via passage 45.

When the secondary fluid enters the chamber 38, its pressure unseats the poppet 42 and thus opens the inlet valve 40 against a closing force provided by a spring 44. Working fluid (steam) is then able to enter the cylinder pre-chamber 46 via steam feed-lines 48 from the boiler 12.

When the solenoid 18 is de-energised, the closing force of spring 36 closes the poppet valve 34, shutting off the steam to the inlet valve chamber 38, which in turn allows the closing force of spring 44 to shut off steam to the expansion chamber. In this respect, it should be noted that steam is able to exhaust from the inlet valve chamber 38 via a port 39 to a system condenser, as necessary.

In relation to the timing of the operation of the solenoid 18, and returning to FIG. 1, the timing disc 20 includes two upper protrusions 52 and 54 and a lower protrusion (not shown) on the underside of the disc about 30° around from protrusion 52.

Sensors 56 and 58 sense the protrusions as the timing disc rotates with the crankshaft 28. Protrusion 54 passes sensor 56 at TDC (as is evident by the position of the piston 32 in FIG. 2), whilst protrusion 52 passes this sensor 90° before TDC. The times of these protrusions passing these points are recorded as dynamic parameters in a control module (which may include a microcontroller), which is a part of the actuating means of the present invention.

The control module, as mentioned above, is then able to calculate the appropriate time to energise the solenoid, in light of the known delay time of the solenoid due to its inductance, and the inertia and pressure forces of the pilot and inlet valves, to open the inlet valve at or near TDC as required. With appropriate programming of suitable set and dynamic parameters, the control module will do this accurately despite fluctuations in speed over the cycle, and despite increases or decreases in the speed of the engine.

The lower protrusion (not shown), passes sensor 58 at some time after TDC (in this embodiment, at about 30°). This assists the control module to determine the time to de-energise the solenoid 18 to close the inlet valve, again in light of known delay times. In this respect, it will be appreciated that angles smaller or larger than 30° could be used in order to provide large and small expansion ratios respectively.

Referring now to the sequential comparisons between FIGS. 3*a*, 3*b* and 3*c*, the basic operation of the engine becomes clear.

As already mentioned, FIG. 3*a* shows the piston 32 nearing TDC (or having just arrived at TDC) in the cylinder 30. The solenoid 18 is de-energised such that the pilot valve is in its closed condition by virtue of the spring 36 having closed the poppet valve 34. Secondary fluid (steam) is thus denied to the inlet valve 40 and working fluid is thus denied to the expansion chamber.

In FIG. 3*b*, the solenoid 18 has energised to open the poppet valve 34 against the closing force of the spring 36, allowing steam to enter the inlet valve chamber 38. This steam has opened the inlet valve 40 against the closing force of its spring 44 to permit working fluid (steam) to enter the expansion chamber via pathways 43. In FIG. 3*b*, the expansion of this steam has urged the piston away from TDC (towards BDC) on its expansion (power) stroke.

In FIG. 3*c*, the solenoid 18 has again de-energised to close the inlet valve 40 during the last of the expansion stroke and for the entire return stroke.

Figure 4A:
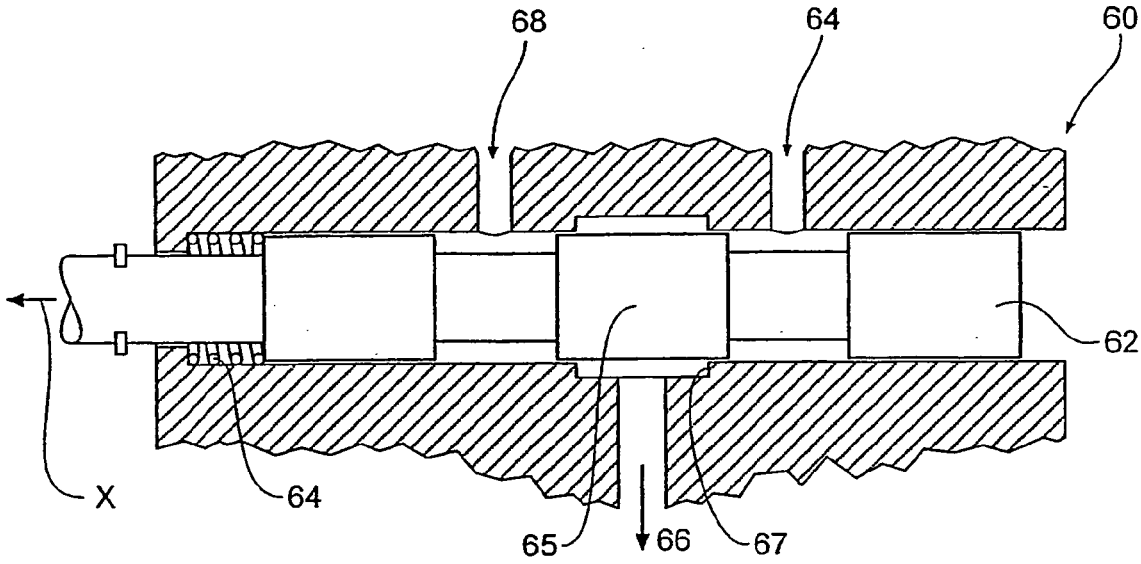
FIGS. 4*a* and 4*b* are schematics of a first alternative pilot valve and inlet valve arrangement respectively for use with an embodiment of the present invention.
Figure 4B:
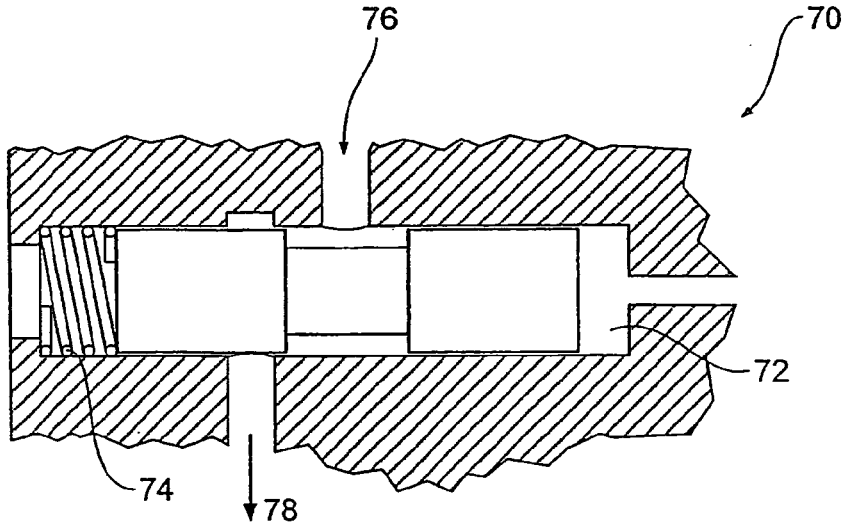
Figure 5:
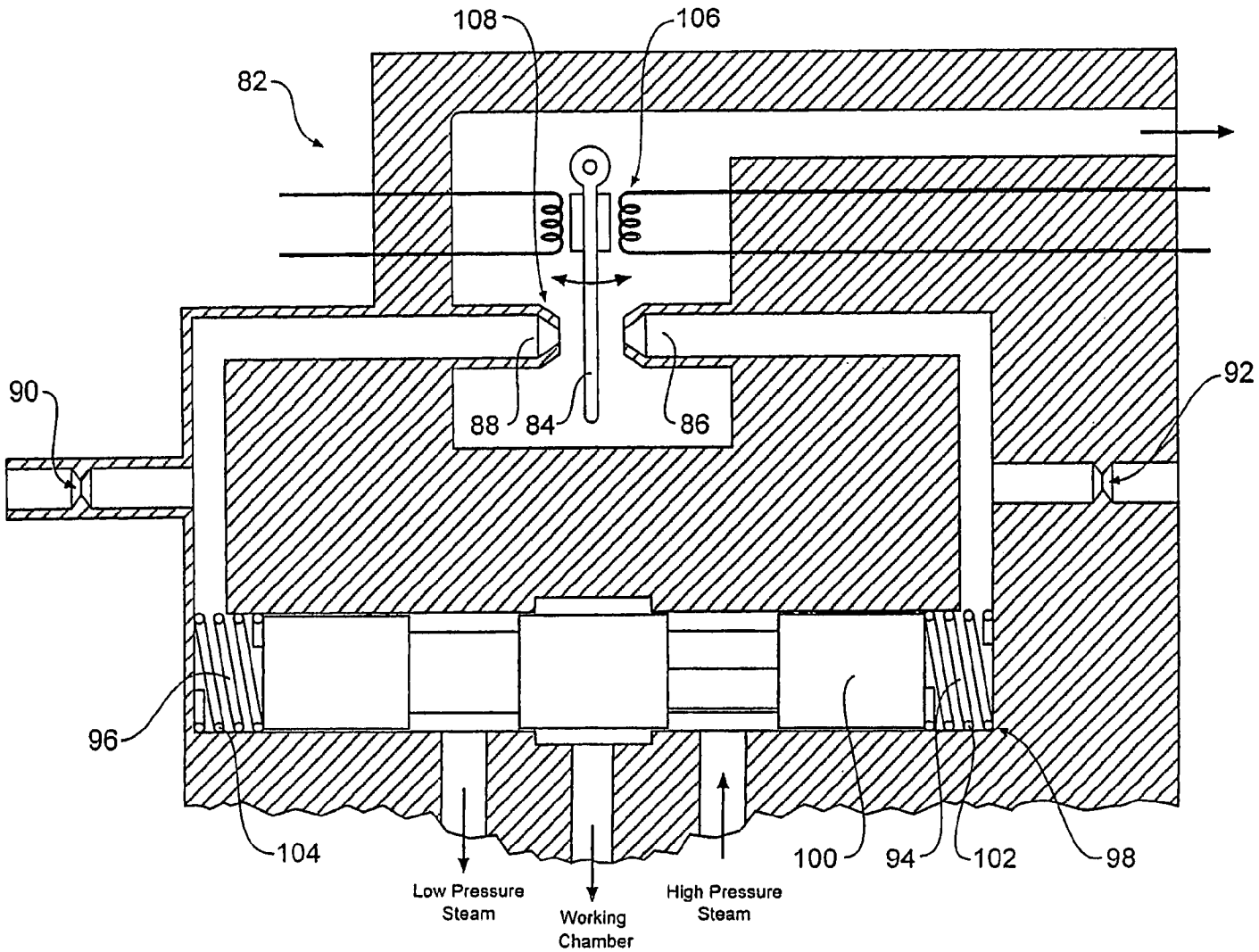
FIG. 5 is a schematic of a second alternative pilot valve and inlet valve arrangement for use with an embodiment of the present invention.

Illustrated in FIGS. 4*a*, 4*b* and 5 are alternative pilot valve and inlet valve arrangements that are also suitable for use with the inlet system of a preferred embodiment of the present invention.

FIG. 4*a* shows a pilot valve in the form of a spool valve 60. The cylindrical spool 62 is actuated by a solenoid (or another suitable mechanical, electromagnetic, or piezoelectric actuator) at X against the return force of a resilient means in the form of a spring 64. In FIG. 4*a*, the spool valve is shown in its closed condition, preventing entry of secondary fluid (steam) into inlet port 64 and then to the outlet port 66. FIG. 4*a* also illustrates the preferred overlapped configuration of the central spool 65 with respect to the stepped entry 67 to the outlet port 66, which avoids any short-circuiting between the inlet port 64 and the low pressure return port 68.

Once energized, the solenoid moves the spool valve to its open condition that, in terms of FIG. 4*a* is to the left of the page, allowing the secondary fluid (steam) to pass therethrough. Upon de-energisation, and upon the return of the spool valve to its closed condition, remaining steam in the valve exhausts via the low pressure return port 68.

FIG. 4*b* shows an inlet valve, also in the form of a spool valve, which operates in a similar manner. However, the spool valve 70 is actuated by the inflow of secondary fluid (steam) to the chamber 72 from the outlet port 66 of the pilot valve.

Again, the spool valve 70 is opened against a return force provided by a resilient means in the form of a spring 74. The high pressure working fluid (steam) enters the spool valve 70 via inlet port 76 when in its open condition, and travels through the spool valve 70 to the outlet port 78 for entry to the working chamber of the cylinder of the engine.

The arrangement illustrated in FIG. 5 differs from the arrangement in FIGS. 4*a*/4*b* by the replacement of the spool arrangement of the pilot valve with a flapper arrangement The flapper arrangement 82 includes a flapper 84 that swings between opposing nozzles 86, 88 due to a continuous stream of secondary fluid (steam) entering via inlet pressure drop orifices 90, 92.

Each nozzle 86, 88 communicates with a respective chamber 94, 96 at each end of the inlet valve, which is itself a spool valve 98 of the same general type as described above. In this arrangement, the cylindrical spool 100 is held central by respective resilient means in the form of springs 102, 104.

As the back pressure of the nozzles 86, 88 differs when the flapper 84 is in a non central position, the flapper itself being electro-magnetically driven by coils 106, 108, the spool 100 is pushed from one side to the other against the centering force of the springs 102, 104 by the pressure imbalance.

Alternatively, instead of the use of the centering springs 102, 104 at each end of the spool 100, a centering feedback spring connected to the flapper may be used.

As will be appreciated, there are various advantages and disadvantages of the different valve arrangements and combinations described in FIGS. 4*a*, 4*b* and 5, which will usually dictate, for particular applications, which configurations will be most suitable.

Figure 6:
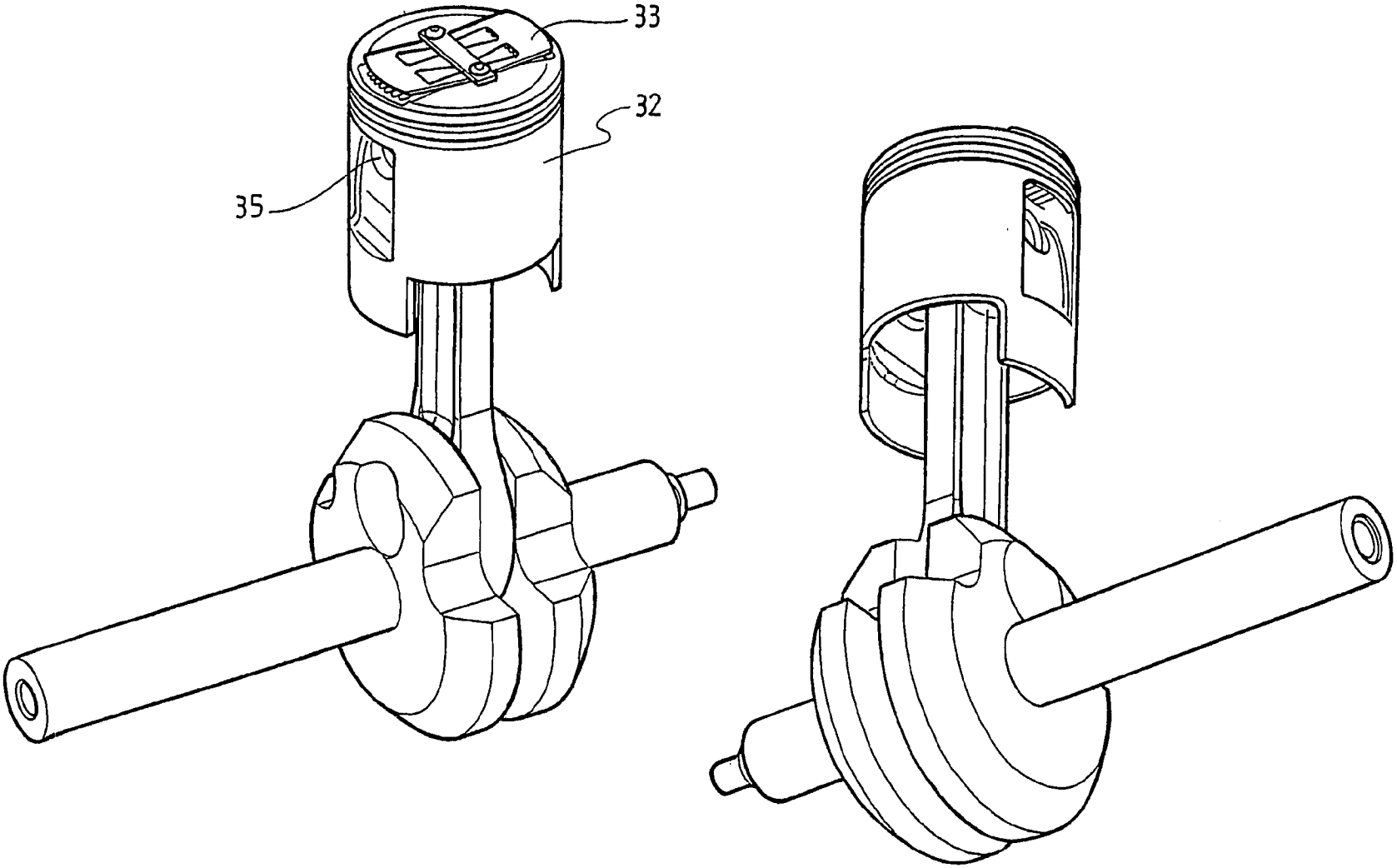
FIG. 6 is a perspective view of a piston adapted in accordance with a further embodiment of the present invention.
Figure 7A:
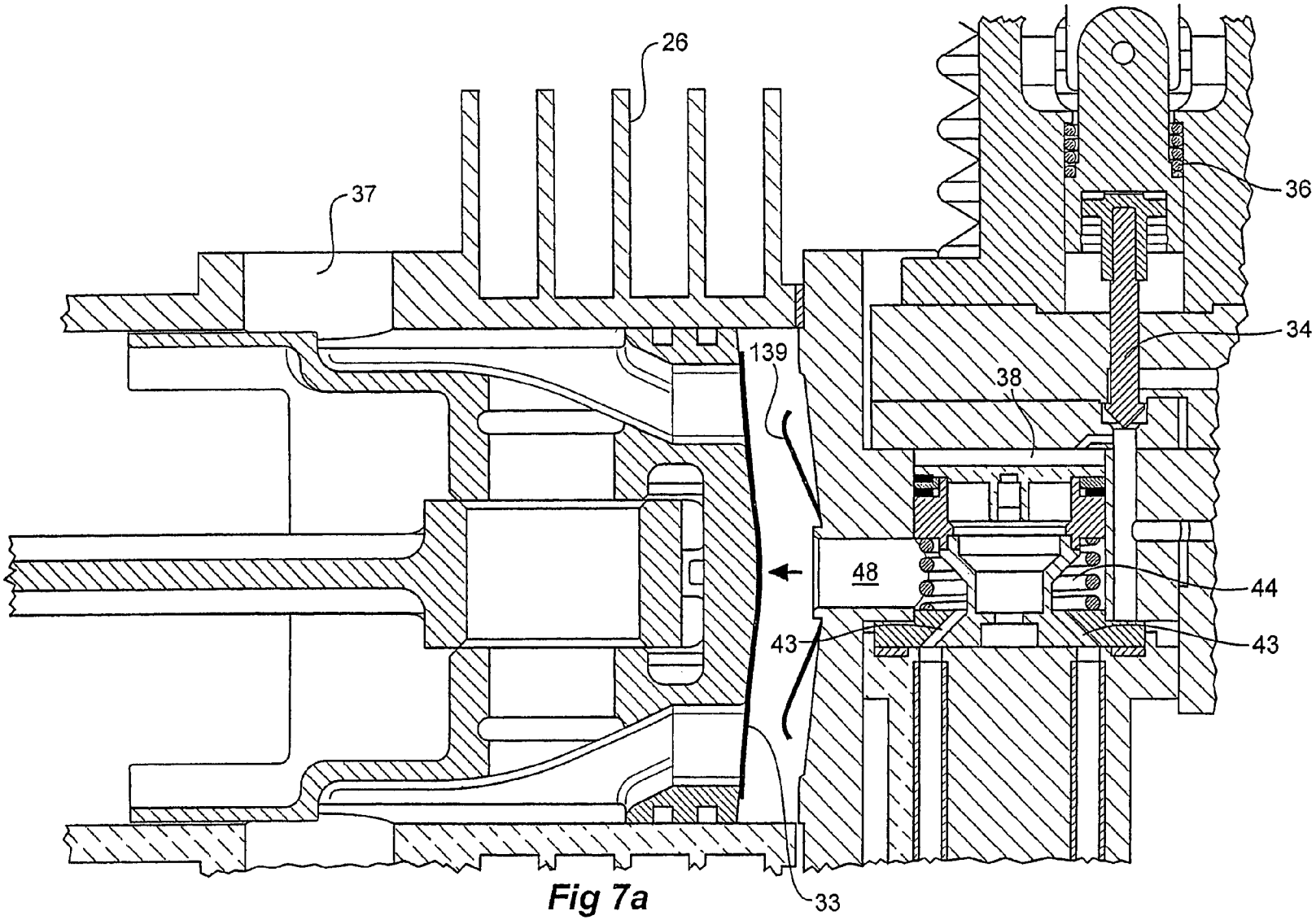
FIGS. 7*a* to 7*d* are exploded views of part of the cross-section of FIG. 2, sequentially showing the operation of the piston of FIG. 6.
Figure 7B:
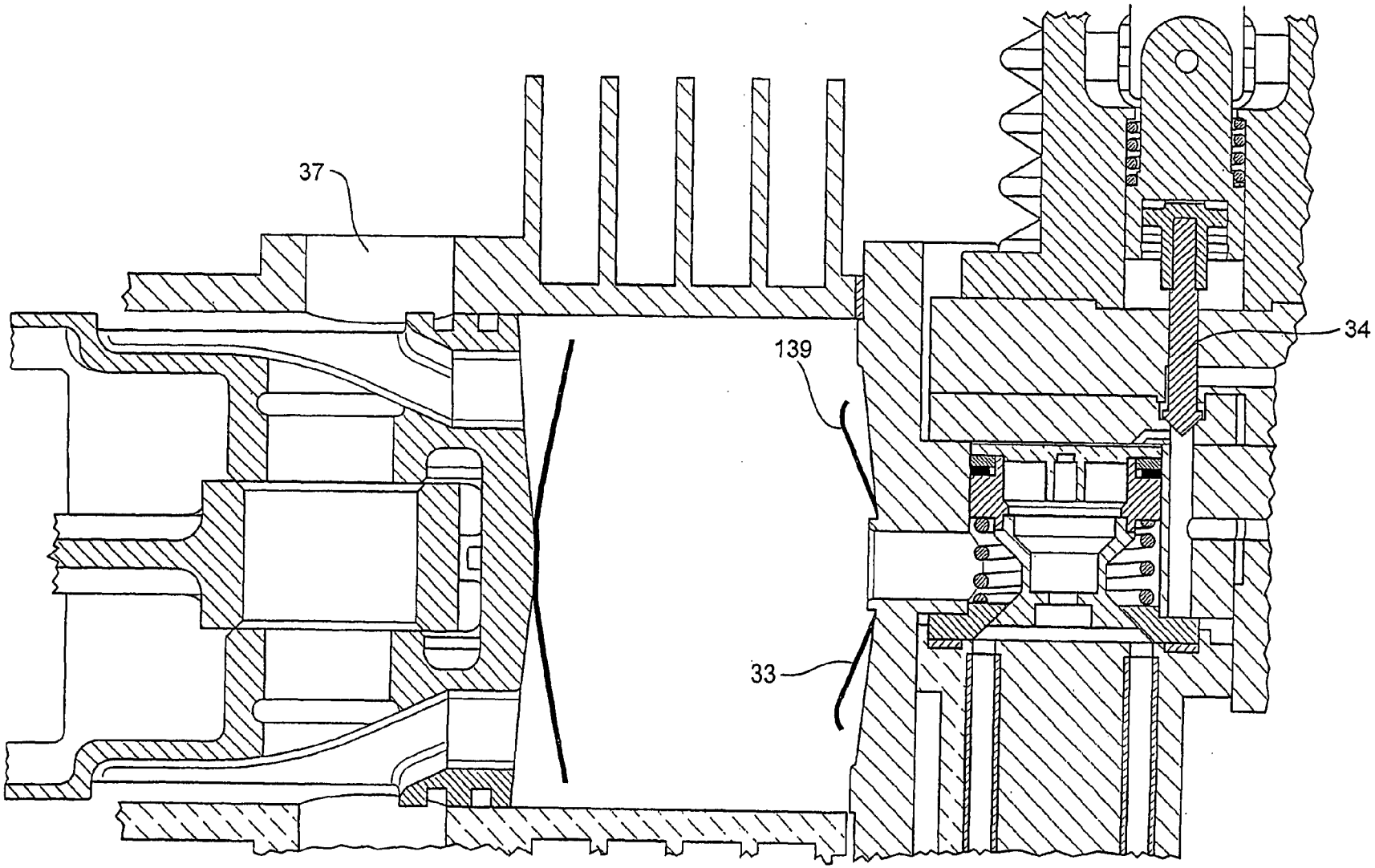
Figure 7C:
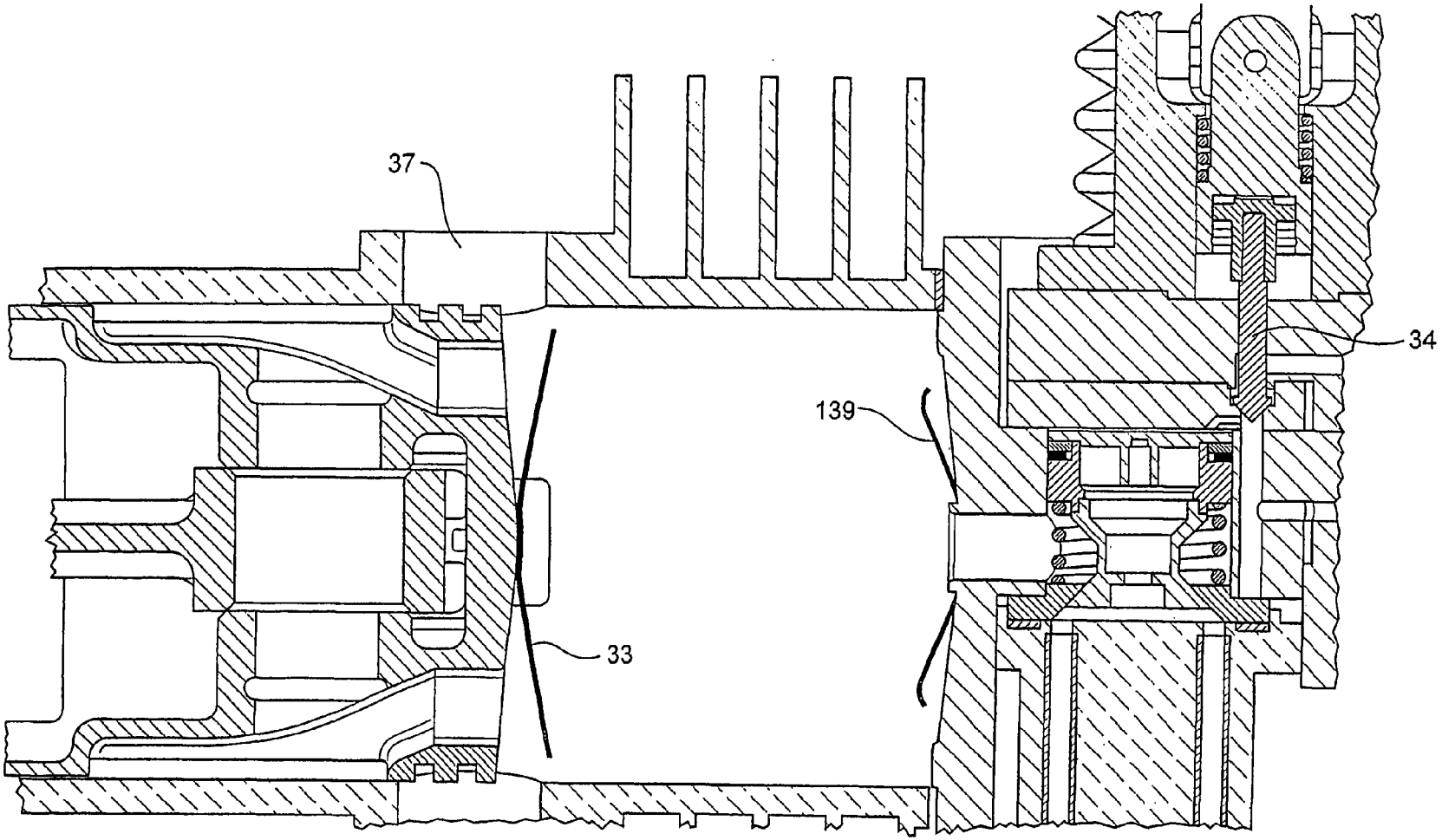
Figure 7D:
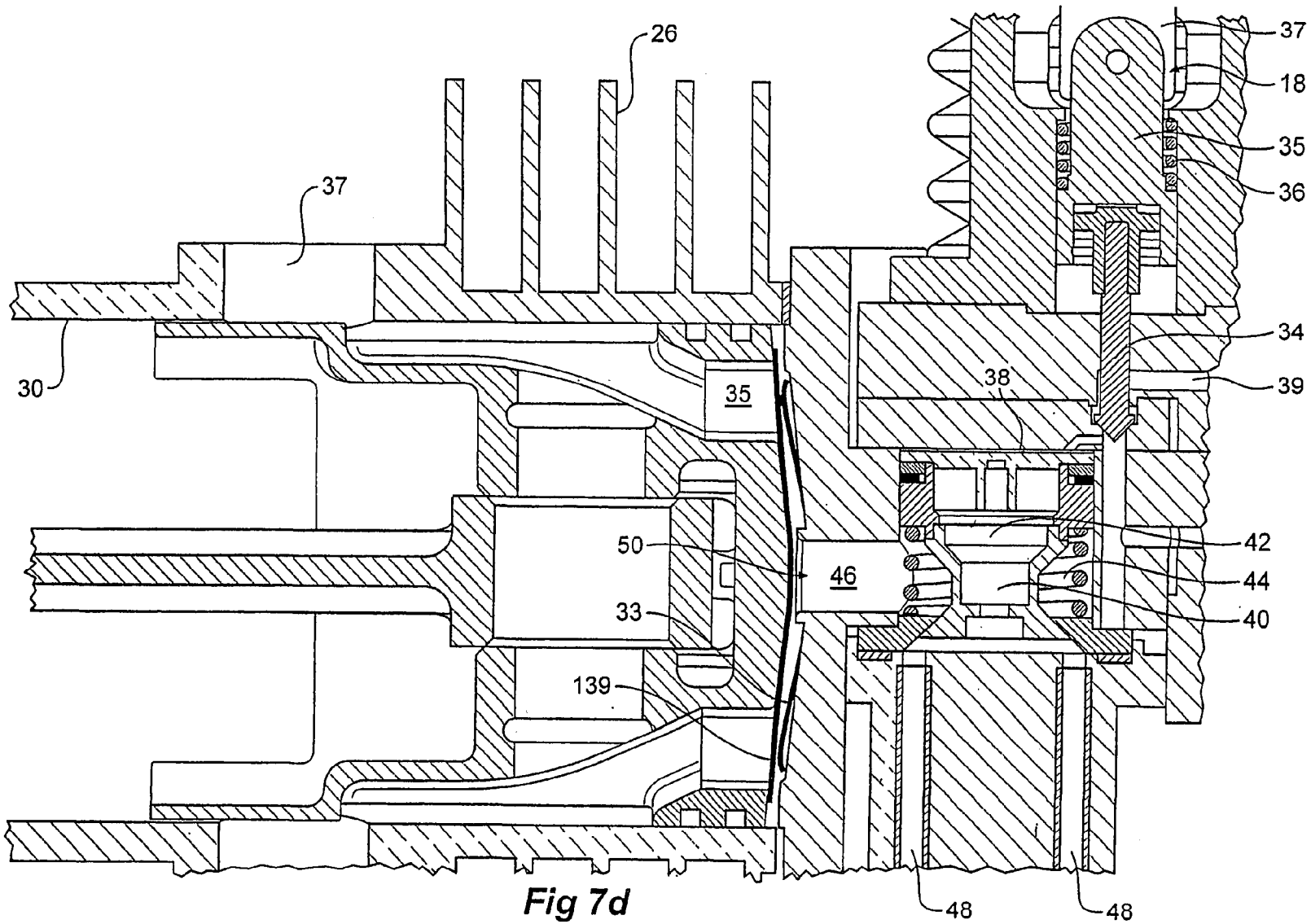

Referring now to the further embodiment illustrated in FIG. 6, illustrated is a piston adapted to include exhaust valves in its head, the exhaust valves being in the form of reed valves 33 associated with exhaust ports 35. In this form, the piston mounted exhaust valve operating sequence is preferably as follows:

1. As the piston travels downwards under the force of expanding gas above it (as shown in FIG. 7*a*), the pressure will gradually drop until the pressure differential above the exhaust port pressure is not sufficient to hold the reed valves closed. At this point, the reed valves will open, which at full load operation will occur just before BDC. It will be noted that opening of these valves is assured by exhaust ports 37 in the cylinder wall opening (or becoming accessible) just before BDC. If the gases have not fully expanded, this can cause the pressure drop required for the reed valves to open.
2. FIG. 7*b* shows the piston just before BDC but before the cylinder wall exhaust ports 37 have been exposed, with the reed valves 33 already open.
3. FIG. 7*c* shows the piston at BDC with the reed valves 33 open.
4. As the piston travels upwards from BDC, the reed valves 33 stay open, allowing all of the gas above the piston to vent through it and out through the ports 37 without a substantial build up of pressure.
5. As the piston nears TDC, leaf springs 139 mounted on the cylinder head (or integral with the head itself contact the reed valves 33, causing the reed valves 33 to close at or before TDC, as illustrated in FIG. 7*d*. If the reed valves 33 close before TDC, some compression of the remaining gases will occur.
6. At this stage, the inlet valve will be open and high pressure gas will enter the relatively small compression volume. As the piston moves away from TDC this gas will hold the reed valves 33 shut, enabling the gas to work against the piston on its downward stroke.

It will be appreciated that this valve arrangement allows maintenance of full uni-flow operation.

Figure 8:
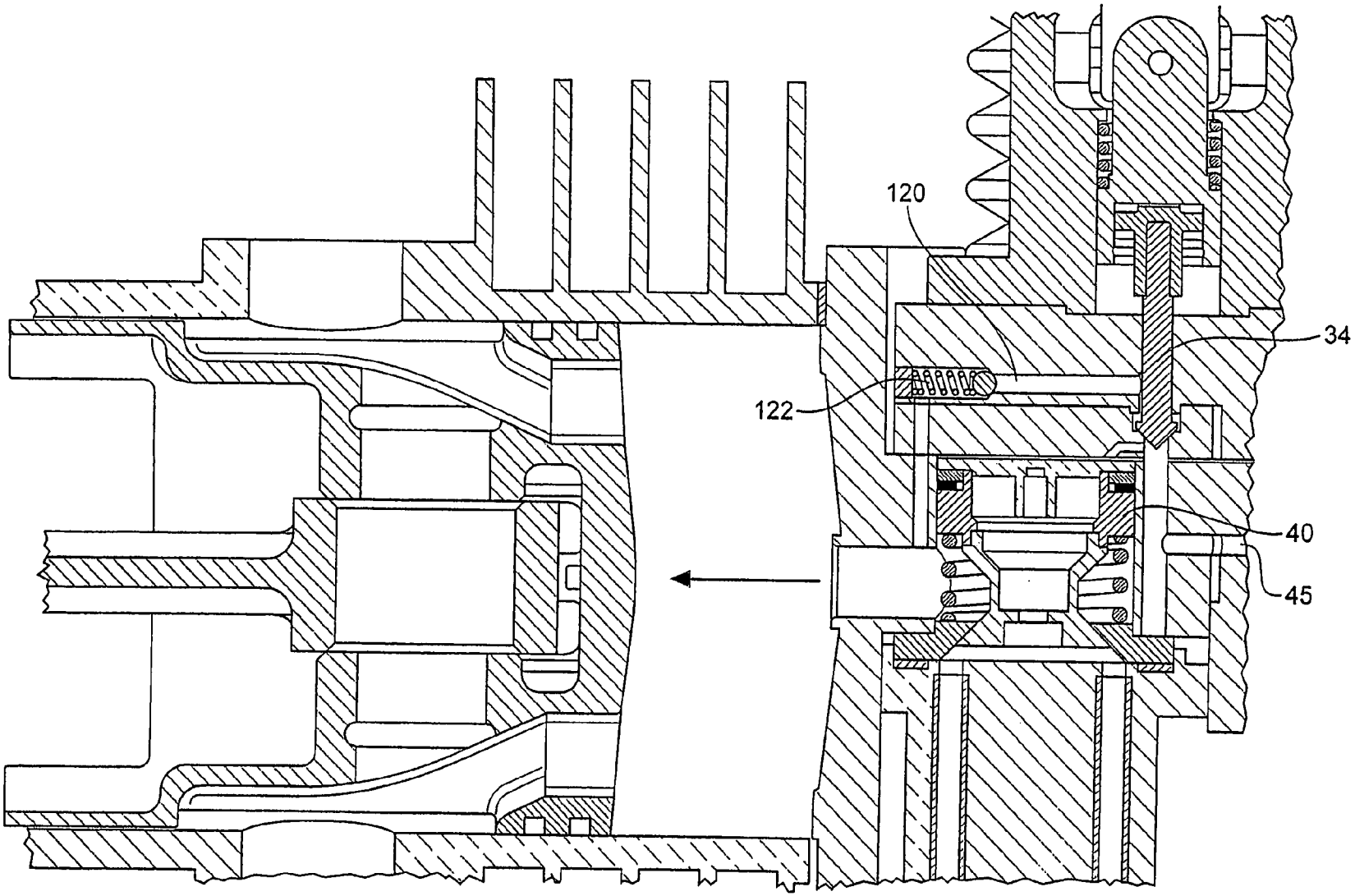
FIG. 8 is an exploded view of a part of the cross-section of FIG. 2 showing a further embodiment of the present invention.

Illustrated in FIG. 8 is a further embodiment, related to the recovery of energy from the inlet valve system, particularly from the operation of the pilot valve and the secondary fluid used to actuate the inlet valve. In this respect, it will be appreciated that the energy used to operate the inlet valve can be significant.

Often the inlet valve will be actuated (via the pilot valve) using a high pressure (secondary) fluid. Where this secondary fluid is compressible, its use may occur without appreciable expansion of the fluid, and some of this energy can be recovered by venting this fluid into the expansion chamber of the cylinder when the inlet valve closes. Ideally, this coincides with the early part of the expansion stroke, allowing the additional fluid to do work against the piston.

FIG. 8 shows an arrangement that vents the secondary fluid into the expansion chamber. When the pilot valve closes, the secondary fluid above the pilot valve exits via a pilot valve exhaust port 120 and then passes via a check valve 122 into the expansion chamber. As the expansion chamber is at high pressure at this time, this may hinder the closing the inlet valve. To assist in preventing this, an additional volume is connected to the exhaust passage upstream of the check valve. This will allow the gas to expand to an intermediate pressure immediately, allowing the inlet valve to shut as required.

When the pressure of the gas in the expansion chamber has dropped sufficiently, this stored gas will then start to exit via the check valve into the expansion chamber.

Finally, it will be appreciated that there may be other variations and modifications made to the configurations described herein that are also with the scope of the present invention.

The invention claimed is:

1. A working fluid inlet system for a reciprocating engine, the engine including at least one cylinder with a reciprocating piston therein and having a variable volume expansion chamber capable of receiving a working fluid via an inlet valve, the inlet system including:

a movable pilot valve having an open condition wherein secondary fluid passes therethrough to act on the inlet valve, and a closed condition; and an actuator device physically separate from the piston and arranged for acting on the pilot valve for controlling movement of the pilot valve;

wherein the inlet valve is adapted to open in response to the action of the secondary fluid.

2. A working fluid inlet system according to claim 1 wherein the working fluid and the secondary fluid are sourced from a single supply.

3. A working fluid inlet system according to claim 2 wherein the single supply is steam from a boiler.

4. A working fluid inlet system according to claim 1 wherein the secondary fluid is any suitable pressurized liquid or gas/vapour.

5. A working fluid inlet system according to claim 4 wherein the secondary fluid is water, air, nitrogen, synthetic and mineral oils, or any suitable mixture thereof.

6. A working fluid inlet system according to claim 1 wherein the pilot valve operates between the open condition and the closed condition, whereby in the open condition the pilot valve permits passage of the secondary fluid therethrough to act on the inlet valve.

7. A working fluid inlet system according to claim 6 wherein the pilot valve is urged towards the open condition against a closing force so that a rest position for the pilot valve is the closed condition.

8. A working fluid inlet system according to claim 7 wherein the pilot valve is configured to act as an emergency relief valve.

9. A working fluid inlet system according to claim 1 wherein the pilot valve includes a poppet valve, a spool valve or a flapper valve.

10. A working fluid inlet system according to claim 1 wherein the pilot valve is a spool valve and the spool valve includes a stepped cylindrical spool in a sleeve that has radial flow ports.

11. A working fluid inlet system according to claim 10 wherein sliding the spool in the sleeve exposes the flow ports to open them.

12. A working fluid inlet system according to claim 11 wherein the valve is of an overlapped type so that a dead zone is provided in the travel of the spool whereat the inlet valve is not a fluid communication with either the supply or the exhaust port.

13. A working fluid inlet system according to claim 1 wherein the pilot valve is a flapper valve that includes a flapper that swings between two opposing nozzles by a continuous stream of secondary fluid via pressure drop orifices.

14. A working fluid inlet system according to claim 13 wherein each nozzle communicates with respective chambers in the inlet valve.

15. A working fluid inlet system according to claim 1 wherein the inlet valve is operable between an open and a closed condition.

16. A working fluid inlet system according to claim 15 wherein the inlet valve is operable in response to the action of the secondary fluid from the pilot valve.

17. A working fluid inlet system according to claim 15 wherein in the open condition the inlet valve permits entry of the working fluid to the expansion chamber of the cylinder to do work on the piston as it expands.

18. A working fluid inlet system according to claim 17 wherein the inlet valve is urged towards the open condition against a closing force so that the rest position for the inlet valve is the closed condition.

19. A working fluid inlet system according to claim 1 wherein the inlet valve is a poppet valve or a spool valve.

20. A working fluid inlet system according to claim 19 wherein the inlet valve is a poppet valve and includes a poppet piston running in a cylinder to a poppet stem and the secondary fluid admitted by the pilot valve exerts force on the poppet piston, overcoming a resilient means which normally holds the poppet shut.

21. A working fluid inlet system according to claim 20 wherein the area of the poppet piston on which the secondary fluid acts is larger than the poppet area, assuming that the pressures of the secondary fluid and the working fluid are the same.

22. A working fluid inlet system according to claim 21 wherein the poppet valve can be oriented in either direction relative to the flow of pressurised fluid as it opens.

23. A working fluid inlet system according to claim 22 wherein the poppet valve is oriented such that the supply pressure tends to hold it closed.

24. A working fluid inlet system according to claim 6 wherein the actuator device controls the operation of the pilot valve between its open condition and its closed condition.

25. A working fluid inlet system according to claim 1 wherein the actuator device provides electromagnetic actuation that is electronically controlled.

26. A working fluid inlet system according to claim 25 wherein the actuator device comprises an electronically controlled solenoid, the electronic control being provided by a control module in association with a timing means.

27. A working fluid inlet system according to claim 26 wherein the control module includes a processing device which is able to process set and dynamic parameters so as to provide a control signal to the solenoid, the control signal being suitable for actuating or holding the solenoid so as to control the pilot valve between its open and closed conditions.

28. A working fluid inlet system according to claim 27 wherein at least some of the dynamic parameters are provided by, or determined using, a signal from the timing means to the control module.

29. A working fluid inlet system according to claim 27 wherein the set parameters reside on the control module so that they are able to be accessed by the processing device.

30. A working fluid inlet system according to claim 29 wherein the set parameters are effectively pre-programmed into the control module.

31. A working fluid inlet system according to claim 26 wherein the timing means includes a timing disc arranged to rotate with the crankshaft of the engine.

32. A working fluid inlet system according to claim 31 wherein the timing disc has pre-set protrusions thereon configured to be representative of predetermined crank-angle positions.

33. A working fluid inlet system according to claim 32 further including timing sensors capable of sensing the passing of respective protrusions to generate timing signals for the processing means in order to determine crank-angle speed and position data.

34. A working fluid inlet system according to claim 26 wherein the solenoid is arranged to receive a very high initial voltage, enabling the current, the associated magnetic field, and hence the solenoid plunger retraction force, to build up quickly, minimizing any delay time.

35. A working fluid inlet system according to claim 34 configured so that once the solenoid plunger has commenced moving, the voltage and current are lowered to a holding valve to maintain the plunger in a retracted position, and thus the pilot valve in its open condition, against the resilient means.

36. A working fluid inlet system according to claim 34 further including means for rapidly dissipating the solenoid field energy to ensure rapid plunger extension under the influence of the resilient means when the solenoid de-energises.

37. A working fluid inlet system according to claim 1 further including means for controlling the pressure that builds up in the dead space in the expansion chamber just before the piston reaches top dead centre (TDC).

38. A working fluid inlet system according to claim 37 wherein the pressure controlling means includes a pressure transducer included in the expansion chamber to monitor cylinder pressure.

39. A method of operating a reciprocating engine including at least one cylinder with a reciprocating piston therein and having a variable volume expansion chamber capable of receiving a working fluid via an inlet valve, said engine further including a working fluid inlet system including:

a movable pilot valve having an open condition where secondary fluid passes therethrough to act on the inlet valve, and a closed condition; and an actuator device physically separate from the piston and arranged for acting on the pilot valve for controlling movement of the pilot valve;

wherein the inlet valve is adapted to open in response to the action of the secondary fluid, said method including the steps:

a) as the piston nears top dead centre (TDC), operating the actuating means to open the pilot valve against a closing force, permitting secondary fluid to move thereth rough;

b) the secondary fluid engaging with an inlet valve, causing the inlet valve to open, again against a closing force;

c) the working fluid entering the expansion chamber of the cylinder via the inlet valve, expanding and forcing the piston away from TDC on its expansion (power) stroke, towards bottom dead centre (BDC);

d) operating the actuating means to close the pilot valve, denying secondary fluid to the inlet valve, and allowing the closing force to close the inlet valve e) once the piston has passed BDC, it returns towards TDC on its return stroke, expanded working fluid within the cylinder exhausts exhausting through exhaust valve(s); and f) as the piston again nears TDC, operating the actuating means to open the pilot valve against the closing force, again permitting secondary fluid to move therethrough.

40. A method of operating a reciprocating engine according to claim 39 wherein the exhaust valves are configures so as to open automatically when the pressure above the piston drops to a threshold pressure above the exhaust port pressure.

41. A method of operating a reciprocating engine according to claim 40 wherein the piston includes exhaust ports associated with the exhaust valves and the piston exhaust ports are arranged to vent to aligned exhaust ports in the cylinder wall.

42. A method of operating a reciprocating engine according to claim 41 wherein the piston exhaust ports and the cylinder wall exhaust ports are configured to overlap during the entire stroke, allowing exhaust venting at any crank angle provided the exhaust valves are open.

43. A reciprocating engine including at least one cylinder with a reciprocating piston therein and having a variable volume expansion chamber capable of receiving a working fluid via an inlet valve, said engine further including a working fluid inlet system including:

a movable pilot valve having an open condition where secondary fluid passes therethrough to act on the inlet valve, and a closed condition; and an actuator device physically separate from the piston and arranged for acting on the pilot valve for controlling the condition of the pilot valve;

wherein the inlet valve is adapted to open in response to the action of the secondary fluid.

44. A reciprocating engine according to claim 43 including a plurality of cylinders each having a reciprocating piston and an associated working fluid inlet system.

45. A reciprocating engine according to claim 43 wherein the reciprocating engine is a Rankine cycle engine that uses steam as the working fluid.

46. A reciprocating engine according to claim 43 wherein the at least one cylinder is an expansion volume and the reciprocating piston is a positive displacement expander.

47. A reciprocating engine according to claim 43 wherein the working fluid and the secondary fluid are sourced from a single supply.

48. A reciprocating engine according to claim 47 wherein the single supply is steam from a boiler.

49. A reciprocating engine according to claim 43 wherein the secondary fluid is any suitable pressurized liquid or gas/vapour.

50. A reciprocating engine according to claim 49 wherein the secondary fluid is water, air, nitrogen, synthetic and mineral oils, or any suitable mixture thereof.

51. A reciprocating engine according to claim 43 wherein each cylinder includes at least one exhaust valve and each piston includes a head having at least one exhaust valve.

52. A reciprocating engine according to claim 51 wherein the piston head exhaust valve includes a spring, reed valve or a poppet valve with compression coil spring arrangements.

53. A reciprocating engine according to claim 52 wherein the piston head exhaust valve is a reed valve and a leaf spring is used at the head of the cylinder to assist in closing the reed valve.

54. A reciprocating engine according to claim 53 further including fluid jets emanating from the cylinder head, or a fluid coating on the springs themselves are provided to cushion the impact of the piston head exhaust valves on the cylinder head.

55. A reciprocating engine according to claim 43 wherein the engine is a Rankine cycle heat engine.

56. A reciprocating engine including at least one cylinder with a reciprocating piston therein and having a variable volume expansion chamber capable of receiving a working fluid via an inlet valve, said engine including a working fluid inlet system and exhaust means, said working fluid inlet system including a pilot valve having an open condition where secondary fluid passes therethrough to act on the inlet valve, and a closed condition and actuating means for controlling the condition of the pilot valve, wherein the inlet valve is adapted to open in response to the action of the secondary fluid, and said exhaust means including at least one exhaust valve in the piston and at least one exhaust port in the pistons said exhaust valve being configured to open automatically when the pressure above the piston drops to a threshold pressure above an exhaust port pressure.

57. A reciprocating engine according to claim 56 wherein said at least one exhaust port in the piston is arranged to vent to an aligned exhaust port in the cylinder wall and wherein the exhaust ports in the piston and the cylinder wall are configured to overlap during substantially the entire stroke of the cylinder provided the exhaust valves are open.

58. A reciprocating engine according to claim 57 wherein the piston head exhaust valve includes a springs, reed valve or a poppet valve with compression coil spring arrangements.

59. A reciprocating engine according to claim 57 wherein the piston head exhaust valve is a reed valve and a leaf spring is used at the head of the cylinder to assist in closing the reed valve.

60. A reciprocating engine according to claim 59 further including fluid jets emanating from the cylinder head, or a fluid coating on the springs themselves so as to cushion the impact of the piston head exhaust valves on the cylinder head.

61. A reciprocating engine according to claim 56 wherein the engine is a Rankine cycle heat engine.

* * * * *